US006789267B2

(12) United States Patent
Ahn

(10) Patent No.: US 6,789,267 B2
(45) Date of Patent: Sep. 14, 2004

(54) HAT WITH ROTATABLE BRIM

(75) Inventor: Oliver Ahn, Cedar Grove, NJ (US)

(73) Assignee: 3 Sixty Innovations, LLC, Syosset, NY (US)

( * ) Notice: Subject to any disclaimer, the term of this patent is extended or adjusted under 35 U.S.C. 154(b) by 0 days.

(21) Appl. No.: 10/667,840

(22) Filed: Sep. 22, 2003

(65) Prior Publication Data

US 2004/0055073 A1 Mar. 25, 2004

Related U.S. Application Data

(63) Continuation of application No. PCT/US03/26539, filed on Aug. 26, 2003.
(60) Provisional application No. 60/406,180, filed on Aug. 26, 2002.

(51) Int. Cl.[7] ..... A42B 1/00
(52) U.S. Cl. ..... 2/195.1; 2/175.1; 2/181
(58) Field of Search ..... 2/175.1, 195.1, 2/171.1, 171.4, 171.7, 171.8, 209.11, 209.12, 209.13

(56) References Cited

U.S. PATENT DOCUMENTS 5,113,529 A * 5/1992 Carr ..... 2/13
5,471,684 A * 12/1995 Casale ..... 2/195.1
6,175,963 B1 * 1/2001 Loeffelholz ..... 2/209.13
6,263,508 B1 * 7/2001 Davis ..... 2/10
6,473,907 B1 * 11/2002 Harwood ..... 2/209.13

* cited by examiner

*Primary Examiner*—Katherine Moran
(74) *Attorney, Agent, or Firm*—Myron Greenspan; Lackenbach Siegel LLP

(57) ABSTRACT

There is provided a hat comprising a crown portion, a brim removably and rotatably attached to the crown portion by a sliding assembly, a circumferential band attached along its lower edge to the lower periphery of the crown portion and having at least a first part of the sliding assembly attached thereto, a headband attached to the circumferential band and/or the crown portion, but preferably not to the sliding assembly, that is disposed between the sliding assembly and a wearer's head when the hat is worn. The sliding assembly comprises a first member at least partially secured to the inside of the crown portion and/or the circumferential band, and a second member at least partially secured to the brim. The sliding assembly is preferably vertically oriented so that, in particular, the sliding assembly may be recessed from the lower periphery of the crown portion for improved functioning and aesthetics.

44 Claims, 6 Drawing Sheets

HAT WITH ROTATABLE BRIM

This application is a continuation application under 35 U.S.C. 111 of co-pending PCT International Application No. PCT/US03/26539 filed Aug. 26, 2003 designating the United States, and which is incorporated in its entirety herein. Through PCT International Application No. US03/26539, this application claims priority of U.S. Provisional Patent Application No. 60/406,180 filed Aug. 26, 2002, and which is incorporated in its entirety herein.

BACKGROUND OF THE INVENTION

1. Field of the Invention

This invention relates to headcovers with a horizontally extending brim or visor, such as hats and caps. More specifically, this invention relates to hats and caps having a brim or visor that may be moved or rotated to various positions around the circumference of the crown of the headwear.

2. Description of the Prior Art

U.S. Pat. No. 5,471,684 issued to Casale on Dec. 5, 1995 for a Convertible Sports Cap with Sliding Brim. The Casale Patent provides a sports hat construction with a head covering portion and a brim portion. An elongate band or strip is selectively attached to the lower periphery of the head covering, and the brim includes a mating connector that is adapted to engage the elongate band, so that the brim can be moved along the longitudinal length of the periphery of the cap. Also, the head covering portion may be removed from the elongate band so that the brim and elongate band may be worn as a sun visor without the head covering portion.

The Casale Patent does not disclose or suggest the use of a headband disposed between the head covering portion or crown and the head of the wearer. The use of such a headband has several advantages, as discussed below. Moreover, while the Casale Patent describes that the elongate band is formed into a closed loop, the Casale Patent does not disclose an elongate band adapted to allow a full 360° rotation of the brim. In fact, the Casale Patent describes that the fastener between the two ends of the elongate band includes a generally flat thin stop, which clearly does not allow for a full 360° rotation of the brim.

U.S. Pat. No. 5,533,211 issued to Mehrens on Jul. 9, 1996 for a Slidably Repositionable Hat. The Mehrens Patent provides a hat having an attached accessory such as a visor and incorporating a headband formed integrally with a sliding member positioned adjacent the opening in the crown. In a first embodiment, a track is secured internally to the crown and slidingly engages the sliding member to permit the crown and attached visor to be rotated relative to the wearer's head without removing the hat. In a second embodiment, the sliding member is secured externally of the crown and slidably supports a track that is attached to the visor.

Unlike the present invention, the Mehrens Patent provides in its first embodiment that the entire hat rotates (i.e., both crown and brim), which is undesirable, for example, when the wearer desires to have a logo always at the front of the crown portion, or to face in a direction of the wearer's choice, independent of the wearer's choice of brim position. In its second embodiment, unlike the present invention, the sliding assembly is external of the crown portion, which is very disadvantageous, especially in terms of aesthetics. Moreover, the horizontal orientation of the sliding member and track in the Mehrens Patent makes the hat bulky and creates a relatively large gap between the crown and the wearer's head.

U.S. Pat. No. 5,715,534 issued to Mobley on Feb. 10, 1998 for Hats and Caps with Moveable Bills or Brims. The Mobley Patent provides headwear comprising (i) a crown having a substantially circumferential body to fit on a wearer's head and having an inner surface, (ii) a headband with an outer surface and attached to the inner surface of the crown body along the circumference of the crown body and forming a free flap on the crown body, (iii) at least one bill or brim extending substantially laterally away from the crown body and a wearer's head, and (iv) at least one slide means for connection of the bill or brim to the crown body and for rotation of the bill or brim relative to the crown body. The slide means comprises a first channel member attached to the periphery of the crown body and extending a substantial portion around the circumference of the crown body, and a second channel member attached to the bill or brim adjacent the crown body, the first and second members having interlocking means for slidable engagement of the second channel member relative to the first channel member. The first channel member is attached to the outer surface of the headband between the headband and the flap of the crown body, in which the flap covers the first channel member and the headband prevents the first channel member from touching a wearer's head. Alternatively, the first channel member is attached to the outer surface of the crown body.

The Mobley Patent is distinguished from the present invention for several reasons. Significantly, the Mobley Patent does not disclose or suggest attaching a channel member to the inner surface of the crown body. Rather, the Mobley Patent provides that the channel member is attached either the outer surface of the headband or to the outer surface of the crown body. Attaching the channel member to the inner surface of the crown body has several advantages, as discussed below. In particular, by locating the channel member on the outer surface of the headband, a "loose flap" (column 3, line 30 of the Mobley Patent) is created around the periphery of the crown portion, which can be inadvertently and undesirably flipped up to reveal the channel member. Also, the Mobley Patent does not disclose or suggest that the channel member attached to the brim extends vertically away from the brim, or that the interlocking channel members are vertically oriented.

U.S. Pat. No. 5,870,772 issued to Sprouse on Feb. 16, 1999 for a Flexible Tracking Assembly for a Sports Cap Having a Rotatable Visor or the Like. The tracking assembly, as described by the Sprouse Patent, may be a single semi-rigid elongated member, preferably I-shaped, or a three-piece assembly having two elongated plastic member attached together along one edge with a generally I-shaped track therebetween. However, unlike to present invention, the Sprouse Patent does not disclose a comfortable headband assembly disposed between the tracking assembly and the head of a wearer. Rather, the Sprouse Patent provides that the headband is held apart from the I-shaped member by a third elongated plastic member. Furthermore, the horizontal orientation of the I-shaped member C-shaped members of the Sprouse Patent makes the hat bulky and creates a relatively large gap between the crown and the wearer's head.

U.S. Pat. No. 6,263,508 issued to Davis on Jul. 24, 2001 for a Means for Moveable Bills or Brims of Caps and Hats. This invention is described as an improvement over the inventor's previous patent, which is the Mobley Patent discussed above. The improvement lies in the addition of a "linking band" between the headband and the interior of the crown of the hat. Nonetheless, as with the Mobley Patent discussed above, the Davis Patent discloses that the sliding track is attached to the outer surface of the headband or the outer surface of the crown, which is unlike the present invention. In fact, the addition of a linking band would further accentuate the disadvantages of attaching the sliding track to the headband. In particular, the linking band would further weaken the "loose flap" (see column 3, line 27 of the Davis Patent) along the bottom periphery of the crown, thereby allowing the loose flap to be too easily flipped up to reveal the sliding track, which would adversely affect the aesthetics of the hat. Also, the Davis Patent does not disclose or suggest that the interlocking or sliding member on the brim extends vertically away from the brim, or that the sliding track and interlocking member are vertically oriented.

SUMMARY OF THE INVENTION

In light of the foregoing, it is an object of the present invention to provide a hat with a brim that is rotatable relative the crown portion thereof.

It is another object of the present invention to provide such a rotatable brimmed hat having a comfortable headband disposed between the rotating assembly and a wearer's head.

It is a further object of the present invention to provide a hat with a brim, a crown, and a headband, wherein the brim is removably and slidably attached to the crown portion along a elongated track or channel that is attached to the crown portion opposite and separate from the headband, which offers several advantages, such as enhancing the stiffness of the lower periphery of the crown portion and also enhancing the wearer's comfort.

In order to achieve the above objects, as well as other objects which will become apparent to those skilled in the art, there is provided a hat comprising a crown portion, a brim removably and rotatably attached to the crown portion by a sliding assembly, a circumferential band attached along its lower edge to the lower periphery of the crown portion and having at least a first part of the sliding assembly attached thereto, a headband attached to the circumferential band and/or the crown portion, but preferably not to the sliding assembly, that is disposed between the sliding assembly and a wearer's head when the hat is worn. The sliding assembly comprises a first member at least partially secured to the inside of the crown portion and/or the circumferential band, and a second member at least partially secured to the brim. The sliding assembly is preferably vertically oriented so that, in particular, the sliding assembly may be recessed from the lower periphery of the crown portion for improved functioning and aesthetics. Vertical orientation of the sliding assembly also minimizes the space created by the sliding assembly between the crown portion and the wearer's head. Optionally, the circumferential band may be omitted and the first part of the sliding assembly may be attached directly to the inside of the crown portion. Attaching the first member of the sliding assembly to the inside of the crown portion or the circumferential band provides several advantages in function and aesthetics, such as, for example, the lower periphery of the crown portion is less likely to inadvertently and undesirably flip up to reveal the sliding assembly.

In a preferred embodiment of the present invention, the sliding assembly comprises a track member and a channel member that is adapted to slide along the track member. The track member is T-shaped and the channel member is C-shaped, such that the C-shaped channel member is retained by and slides along the crossbar of the T-shaped channel member. The T-shaped track is attached along the entire lower periphery of the crown portion of the hat, and the C-shaped channel is attached to the brim along an edge thereof that is adapted to be proximate to the crown portion, whereby the brim is slidable around the entire periphery of the crown portion when the C-shaped channel is engaged with the T-shaped track.

Other preferred embodiments of the present invention may comprise one or more of the following elements: (1) a headband disposed to cover the part of the sliding assembly attached to the crown portion, such that the sliding assembly part does not come in contact with the wearer's head; (2) a continuous, unbroken, substantially circular track member extending along the entire lower periphery of the crown portion, whereby the brim may be rotated completely around the entire crown portion; (3) a track member having two ends, wherein the track member is bent into a substantially circular shape extending along the entire lower periphery of the crown portion and having the two ends adjacent to one another, and wherein the two ends are held together by a bridge member, whereby the brim may be rotated completely around the entire crown portion; (4) a track member having two ends, wherein the track member is bent into a semi-circular shape extending along the lower periphery of the crown portion, and wherein an adjustable member is disposed between the two ends of the track member, whereby the size of the crown portion may be changed and the brim may be rotated substantially completely around the entire crown portion; and/or (5) a crown portion having an open top.

DESCRIPTION OF THE INVENTION

Figure 1:
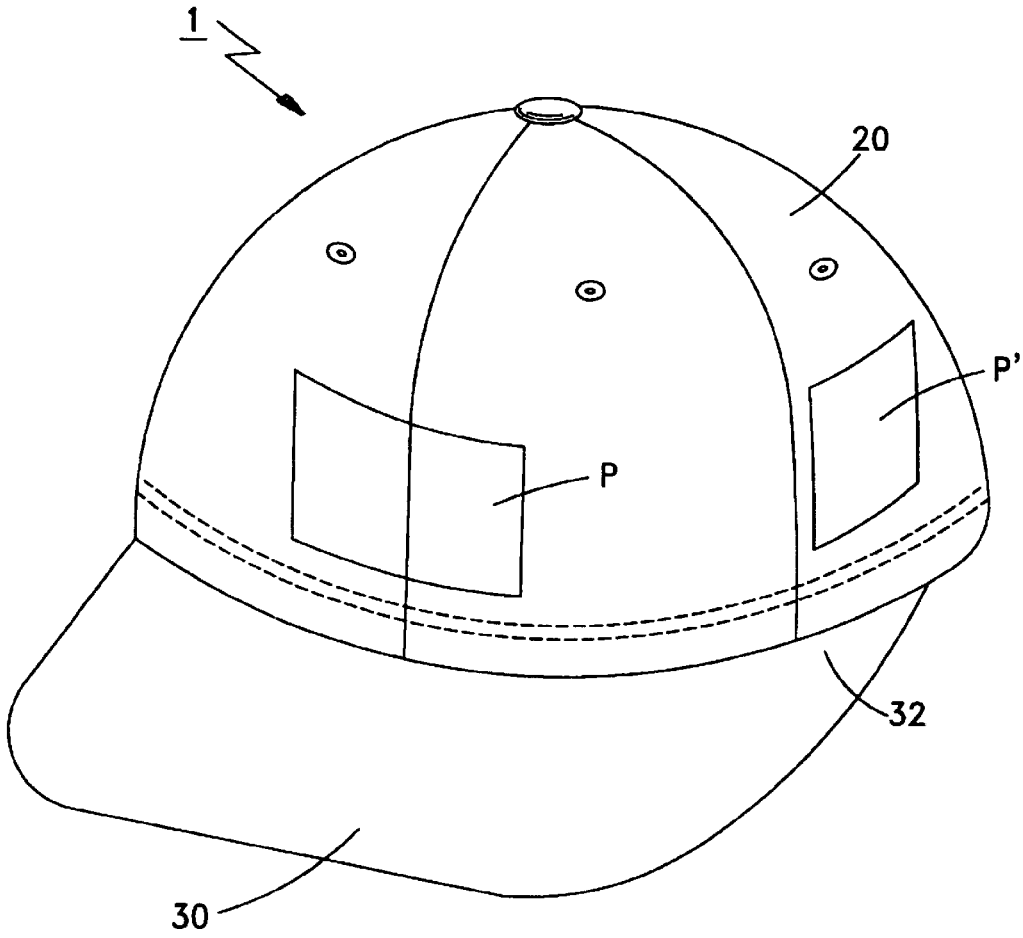
FIG. 1 is a hat according to the present invention.

Referring to the figures and, in particular, FIG. 1, there is shown a hat according to the present invention, generally indicated as reference number 1, comprising a crown portion 20 and a brim 30.

Figure 4:
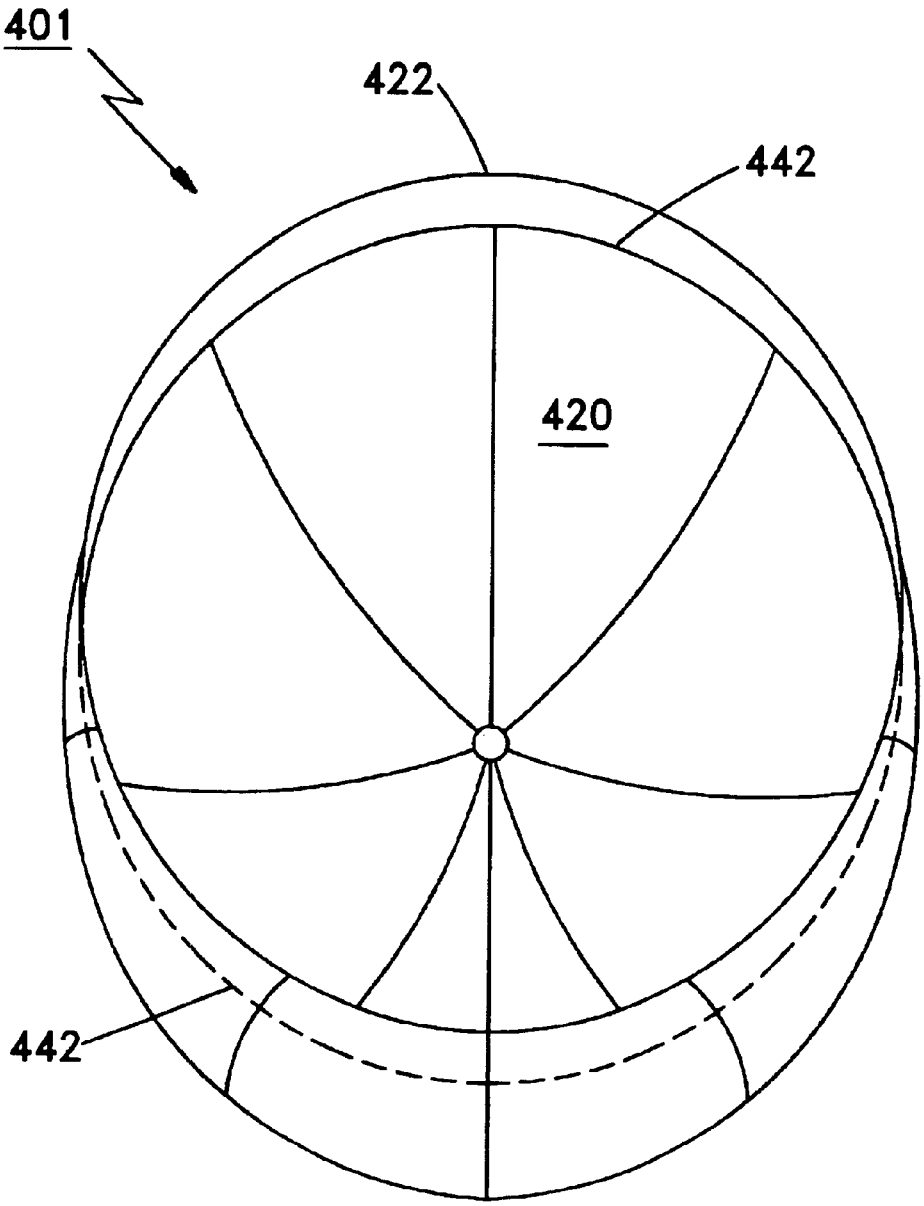
FIG. 4 is a crown portion of a hat according to the present invention showing a continuous, unbroken track member extending around the inside thereof and recessed from the lower periphery.

Referring to FIGS. 1 and 4, crown portion 20 may be constructed using any suitable materials and methods. For example, as shown, crown portion 20 is formed of a plurality of triangular segments, preferably six, that are sewn together to provide a domed shape adapted to cover the top of a wearer's head. The intersection of the stitching at the uppermost point of the crown portion is usually covered with a decorative button or knob, which may be sewn or stapled thereto. With such a configuration, a hat according to the present invention could be classified as a "baseball cap."

As used herein, the outside of crown portion 20 is the side visible to others when hat 1 is worn on a wearer's head, while the inside of crown portion 20 is the side facing the wearer's head when hat 1 is being worn. The opening of crown portion 20 is defined by a generally horizontal lower periphery 22. Crown portion 20 has a vertical central axis c that extends through the topmost point (i.e., the decorative button) of crown portion 20 and perpendicularly to lower periphery 22. Please note that the terms "horizontal" and "vertical," as used herein, are relative terms connotating a perpendicular relationship, whereby the "horizontal" lower periphery may have any absolute orientation, and the "vertical" central axis will have the correspondingly perpendicular absolute orientation.

Figure 6:
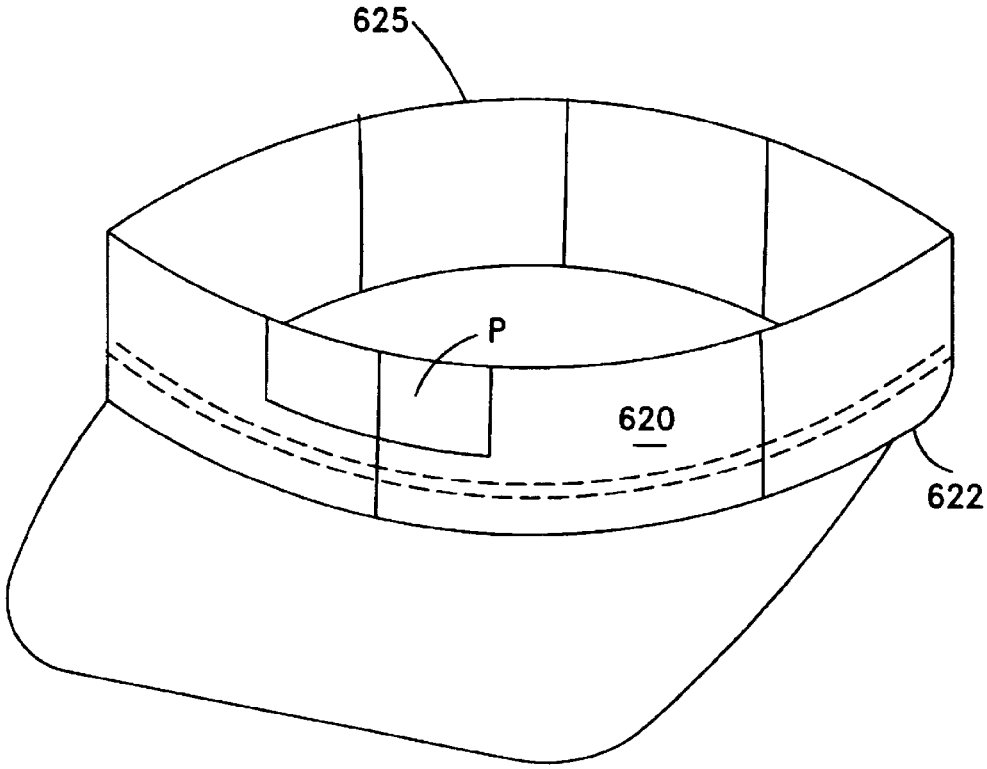
FIG. 6 is a hat according to the present invention having a crown portion with an open top.

Alternatively, as shown particularly In FIG. 6, a hat according to the present invention may comprise a crown portion 620 in a cylindrical shape or the shape of a band having a lower periphery 622 and an upper periphery 623, whereby the hat has an open top or upper opening and an open bottom or lower opening. With such a configuration, a hat according to the present invention could be classified as a "visor."

Brim 30 has a proximate portion 32 that, as shown, is either removably or substantially permanently secured to crown portion 20. Brim 30 extends substantially horizontally away from crown portion 20, so as to provide shade for the wearer's eyes and face. The purpose for which hat 1 is to be used may dictate varying shapes, lengths and angles with respect to brim 30. Brim 30 may be formed by any appropriate method using any suitable material or materials, for example a fabric material that is stitched to, or contains, a stiffening material, such as cardboard or plastic.

Preferably, crown portion 20 has at least one decorative symbol, letter, badge, emblem, or combination of letters or words, such as, for example, a patch P embodying a logo of a sports team. Crown portion 20 may include several decorative or secondary symbols, letters, badges, emblems, words, and combinations thereof. However, in general, one segment of crown portion 20 will have a primary symbol, letter, badge, emblem, word or combination thereof. The segment of crown portion 20 having this primary decoration P is referred to herein as the front segment or section of the cap. The remaining segments or sections of crown portion 20 are referred to herein as side segments, and may include at least one additional or secondary decorative symbol, letter, badge, emblem or combination of letters, or words such as, for example a patch P' as shown. Of course, the side segment of crown portion 20 that is diametrically opposite the front segment of the cap is referred to herein as the back of the cap.

Figure 2:
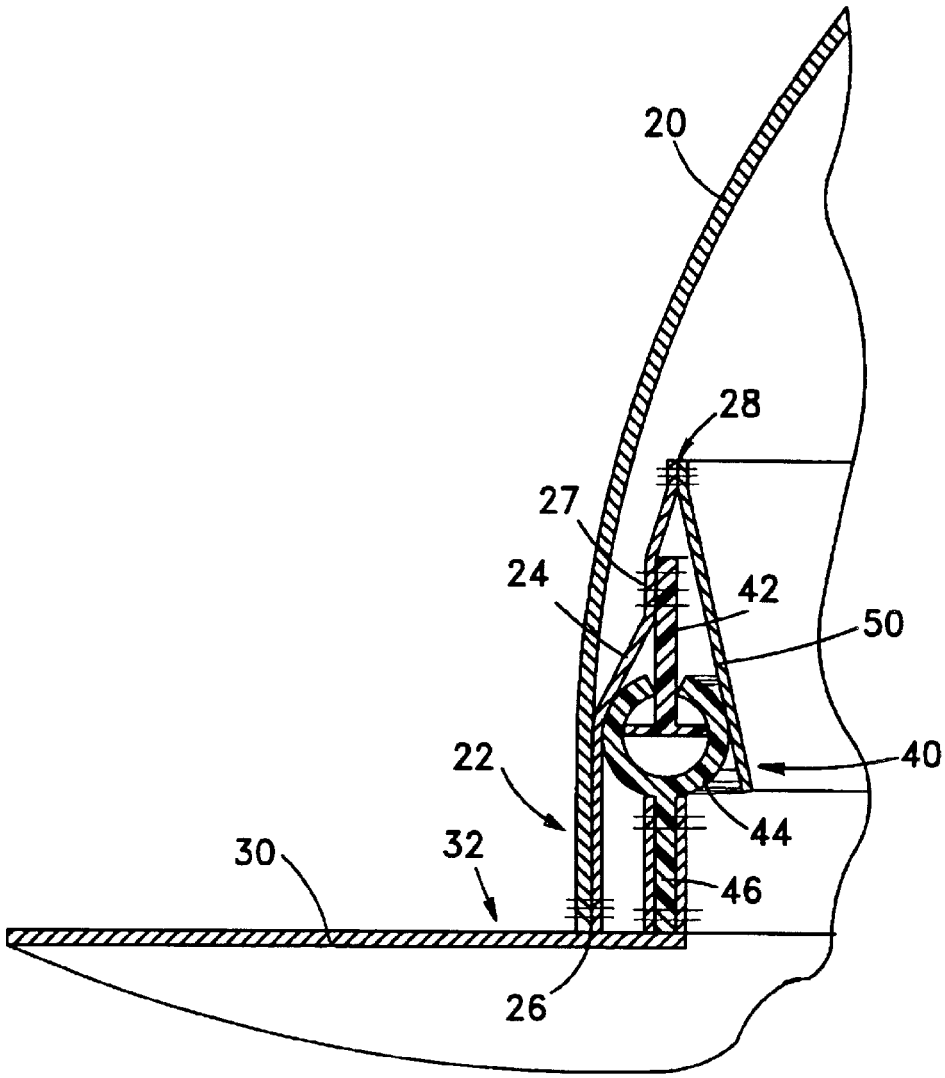
FIG. 2 is a close-up view of the means for rotating the brim of the hat of FIG. 1.

Referring to FIG. 2, there is shown a close-up view of the means for rotating brim 30 relative to crown portion 20.

A sliding assembly, generally indicated as reference number 40, is disposed adjacent to the lower periphery 22 of crown portion 20. A first member 42 of sliding assembly 40 is attached about at least a segment of an circumferential band 24 adjacent to lower periphery 22. Optionally, first member 42 may be attached directly to crown portion 20. A second member 44 is the other one of the at least two slidably engaging members of sliding assembly 40. Second member 44 is attached along at least a segment of proximate portion 32 of brim 30. First and second members 42, 44 are slidable relative to each other when engaged or interlocked.

First member 42 is recessed from lower periphery 22. Preferably, first member 42 is recessed from lower periphery 22 a distance equal to or greater than its height. The height of first member 42 is measured along a line substantially perpendicular to lower periphery 22. For example, in one embodiment, first member 42 is about 0.5 cm in height and recessed from lower periphery 22 a distance of about 0.5 cm. In another exemplary embodiment, first member 42 is about 0.5 inch in height and recessed from lower periphery 22 a distance of about 0.5 inch.

As shown in FIG. 2, in order to attach second member 44 to brim 30 and also slidably engage second member 44 with first member 42 at its recessed position, sliding assembly 40 preferably comprises an extension 46 between brim 30 and second member 44. Extension 46 may be formed integrally with second member 44 and/or brim 30, from the same material (i.e., plastic and/or cloth).

Sliding assembly 40 may have any number of slidably engaging members in any suitable combination. First member 42, as shown, is in the form of an elongate male track having a T-shaped cross-section. As shown, second member 44 is in the form of an elongate female channel having a C-shaped cross-section. Nonetheless, first and second members 42, 44 may have any suitable shape and may be engaged or interlocked in any suitable manner. For example, the slidably engaging members may be the opposite of that shown in FIG. 2, namely first member 42 attached to crown portion 20 may be in the form of a elongate female channel having a C-shaped cross-section, while second member 44 attached to brim 30 may be in the form of an elongate male track having a T-shaped cross-section.

Preferably, sliding assembly 40 has a substantially vertical orientation. In particular, as shown, the opening in the C-shaped channel of member 44 faces up and the cross beam of the T-shaped track is proximate to lower periphery 22. Substantially vertical orientation of sliding assembly 40 may be achieved by other suitable methods of engaging the sliding members. By orienting sliding assembly 40 in the vertical plane, it may be recessed from lower periphery 22 to hide the sliding assembly from view when hat 1 is worn. Moreover, the vertical orientation of sliding assembly 40 supports and strengthens the lower periphery 22 so that lower periphery does not undesirably flop up to reveal sliding assembly 40.

Sliding members 42, 44 can be made out of any suitable material, including a plastic material that has a very smooth surface. A close fit between members 42, 44 provides some contact and friction so that brim 30 will remain in the position the wearer chooses. However, members 42, 44 should slide easily relative to each other without binding.

Sliding members 42, 44 may be any suitable thermoplastic material, such as nylon (a polyamide). When used to make sliding members 42, 44, nylon confers several advantages to hats constructed according to the present invention. In particular, nylon is more resistant to splitting and/or cracking when bent or twisted compared with many other thermoplastic materials. In other words, nylon is suitably malleable so that a hat having sliding members 42, 44 made of nylon may be folded for packing, shipping, and/or storage with little risk that sliding members 42,44 will split and/or crack. Nylon, while being malleable, may also be made sufficiently strong or dense to support the weight of brim 30. Another advantage of nylon is that it is molded in stead of being extruded. The molding process for nylon results in sliding member 42, 44 having very few, if any, surface imperfections, especially compared to extruded thermoplastic materials. The very smooth surface of molded sliding members 42, 44 results in reduced friction therebetween, and increased slidability or "slickness." Yet another advantage of nylon is that it is softer compared with many other thermoplastic materials. Sliding members 42, 44 being made of softer nylon provide greater physical comfort to the wearer.

Figure 3:
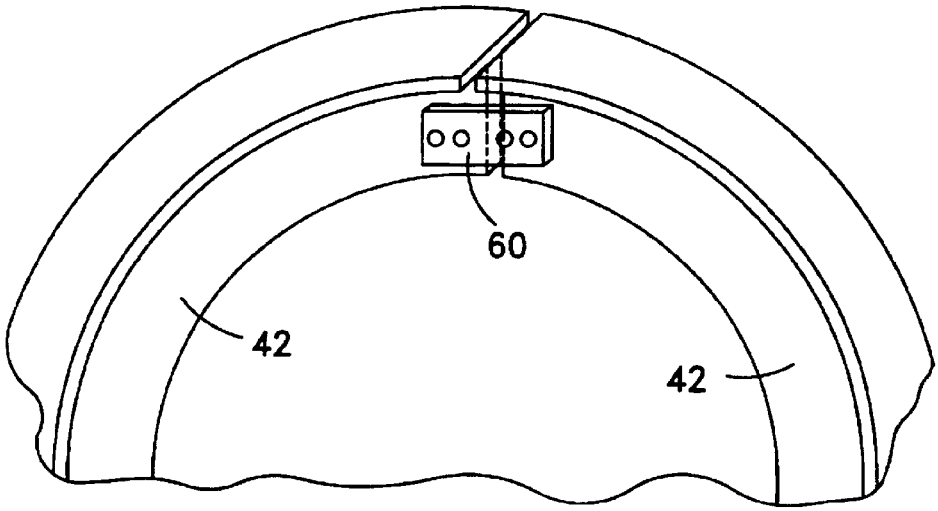
FIG. 3 is a close-up view of the supporting bridge connecting the ends of the first member of the sliding assembly that is inside the crown portion of the hat of FIG. 1.

In a first embodiment, as best shown in FIG. 3, sliding member 42 preferably has at least one break or gap adapted to allow slidable member 44 to releasably engage slidable member 42, such as, by feeding T-shaped sliding member 42 into the upwardly-facing C-shaped channel of sliding member 44. If sliding member 42 is made of an appropriately flexible material, the ends of sliding member 42 may closely abut one another, such that brim 30 may be easily rotated fully 360°, while also allowing the ends of sliding member 42 to be separated, such that brim 30 may be removed from crown portion 20.

In addition, referring to FIG. 3, a supporting bridge 60, may be used to connect at least a portion of the two ends of sliding member 42 to each another, which facilitates free rotation of brim 30. The support bridge would help to maintain the close abutting of the ends of sliding member 42 despite the adverse effects of weather, perspiration, and use over time. Preferably, the supporting bridge would not interfere with the ability of the wearer to slightly separate the two ends to remove brim 30 from crown portion 20. The supporting bridge may be of any appropriate shape and size and may be disposed at any suitable location in any suitable position. For example, the support bridge may be overlapping the ends of member 42 along their respective vertical bars of the T-shaped track.

Referring to FIG. 4, there is shown a crown portion 420 for a hat 401 according to the present invention comprising a continuous, unbroken elongated first member 442 (e.g., a T-shape track) extending completely around the inside of the crown portion 420 recessed from the lower periphery 422 thereof. In comparison to first member 42 described above, the advantage of continuous, unbroken first member 442 is that a second member attached to a brim (not shown) is effectively prevented from sliding off first member 442, and no bridge member is required.

Figure 5A:
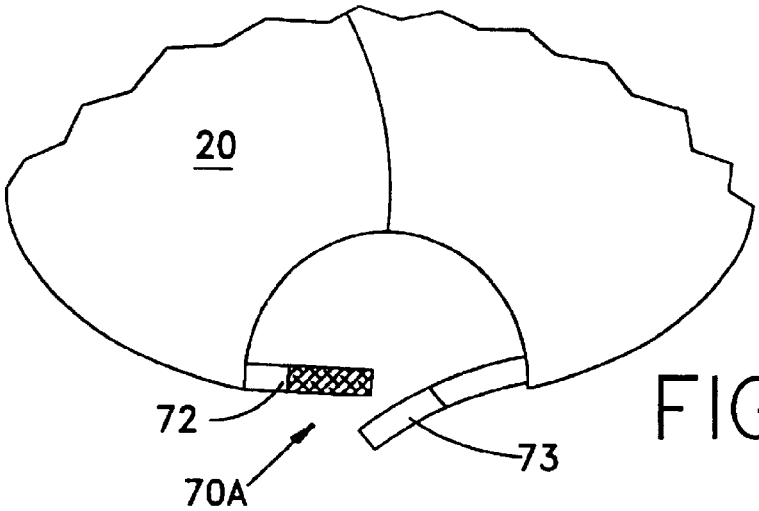
FIG. 5A is a hat according to the present invention having an adjustable member in the crown portion comprising a hook-and-loop closure.
Figure 5B:
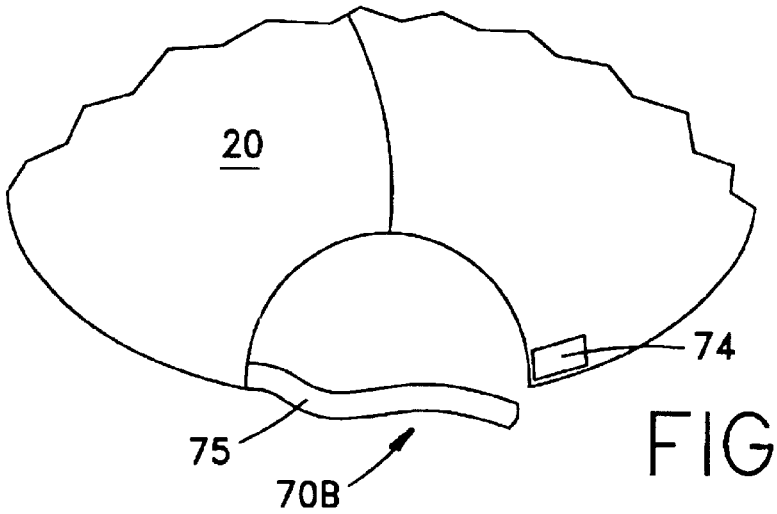
FIG. 5B is a hat according to the present invention having an adjustable member in the crown portion comprising a buckle-and-strap closure.
Figure 5C:
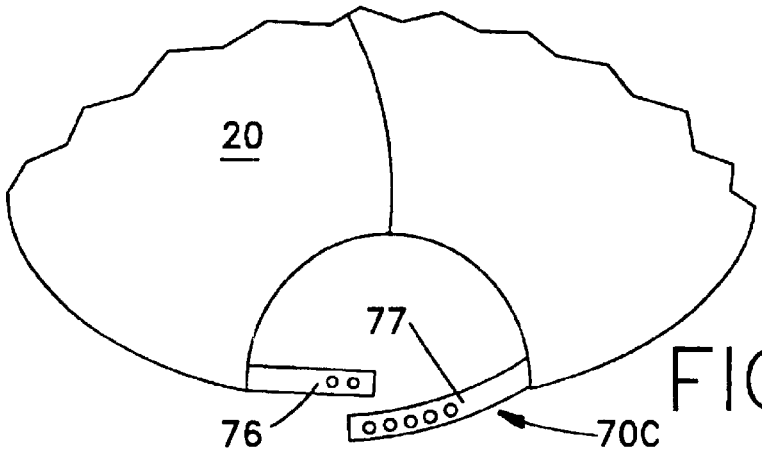
FIG. 5C is a hat according to the present invention having an adjustable member in the crown portion comprising an interlocking closure.

Referring to FIGS. 5A to 5C, there is shown a hat according to the present invention comprising an adjustable assembly, which is adapted to adjust or change the circumferential size of the crown portion 20. Adjustable assembly may comprise, for example and without limitation, hook-and-loop closure assembly 70A (i.e., Velcro® straps 72 and 73), a buckle-and-strap assembly 70B (i.e., buckle 74 for securing a strap 75), or an interlocking assembly 70C (e.g., a strap 76 with pegs adapted to interlock with holes in a strap 77). When hat 20 comprises an adjustable assembly 70, the first member 42 of sliding assembly 40 will not extend completely around the inside of crown portion 20. Instead, first member 42 may extend substantially around the inside of crown portion 20. More preferably, first member 42 may extend around inside of crown portion 20 so as to provide for brim 30 to rotate at least about 180°.

First member 42 may be permanently or semi-permanently attached to circumferential band 24 and/or crown portion 20. When first member 42 is removably attached to crown portion 20, such as with hook and loop fasteners, it becomes possible to remove the crown portion 20 so that sliding assembly 40 and brim 30 may be worn as a visor.

Significantly, a headband or sweatband 50 circumscribes the inside of crown portion 20 adjacent to lower periphery 22. The headband is adapted to be worn against the wearer's head. The headband may be made from any suitable material or combination of materials that provide an acceptable amount of comfort for the wearer. For example, headband 50 may be an extruded plastic material that is covered in a fabric or a leather-like material for the wearer's comfort.

Headband 50 is attached to circumferential band 24 adjacent to their respective upper circumferential edges at least by a seam line 28 using stitching, permanent adhesive, or the like, as is well known in the art. Seam line 28 is spaced above seam line 26 and first member 42 of sliding assembly 40 is attached to band 24 by seam line 27 therebetween. Preferably, headband 50 is not attached to first member 42. Optionally, headband 50 may be attached at a seam line (not shown) to first member 42.

From outermost to innermost, the preferred arrangement of hat 1 comprises crown portion 20, circumferential or intermediate band 24, first and second members 42, 44, and headband 50. Therefore, when hat 1 is being worn, headband 50 is in contact with the head of the wearer, while first and second members 42, 44 are sandwiched between headband 50 and circumferential intermediate band 24, and the only element one of these elements that is attached to crown portion is circumferential intermediate band 24. This is a simple, functional, and attractive design.

Attaching first member 42 of the sliding assembly 40 to the inside of the crown portion 20 or circumferential band 24 supports and strengthens lower periphery 22 so that it does not undesirably flip up to reveal sliding assembly 40. Also, attaching first member 42 to the inside of the crown portion 20 or circumferential band 24 enhances wearer comfort by removing potentially uncomfortable seams from the headband 50.

Another advantage of using circumferential band 24 as described herein is that first member 42, circumferential band 24, and headband 50 can be sewed together prior to attaching circumferential band 24 to crown portion 20. Thus, production of hat 1 can benefit from unit production of the various portions and elements. For example, first member 42, circumferential band 24, and headband 50 can be sewed together at a time and place remote from the construction of crown portion 20, and the separately created elements can then be later sewed together along the single seam 26. This procedure is more efficient compared to a procedure requiring that first member 42 and headband 50 be individually sewed to the inside of crown portion 20.

Assembly of hat 1 may be accomplished using a method suitable method of construction or manufacture. As stated above, any materials may be used to make hat 1. A representative method of construction may include the following steps: (i) forming crown portion 20 by sewing together six triangular segments of a fabric, such as a heavy-weight cotton canvas, and attaching a decorative button at its top; (ii) forming brim 30 by sewing a fabric covering around a cardboard structure; (iii) attaching to the brim in a vertical orientation the slidable member 44 such that the U-shaped or C-shaped channel thereof is upwardly facing; (iv) forming an assembly combining band 24, headband 50, and T-shaped slidable member 42, such that slidable member 42 is fixed to band 24 by a seam 27 and headband 50 is fixed to band 24 by a seam 28, and such that the horizontal cross beam of slidable member 42 is positioned proximate to lower periphery 22 to engage the U-shaped or C-shaped channel of slidable member 44; (v) fixing the assembly adjacent to lower periphery 22 of crown portion 20 by a seam 26 such that slidable member 42 has a break or gap adapted to allow slidable member 44 to engage slidable member 42; and (vi) sliding the U-shaped channel of slidable member 44 into the gap in slidable member 42 and over the horizontal beam of thereof to interlock the slidable members.

In use, a wearer places hat 1 upon the wearer's head with the headband 50 in contact therewith. Brim 30 will normally extend forwardly of the wearer to provide shade to the wearer's eyes. When it is desired to reorient brim 30, such as when it becomes necessary to prevent the wind from lifting the hat from the head, or such as when it becomes necessary to rapidly look upwardly to follow a flying ball for example, brim 30 may rapidly be rotated with respect to crown portion 20 and the wearer's head without removing hat 1. It may be noted that since the hat is not circular (when viewed from the top) the relative translation between the sliding member and the track requires a bending of the track generally in a horizontal plane or in a plane perpendicular to its linear motion. Thus, sufficient friction is assured to maintain the orientation of the visor in a given direction to thus prevent such movement of the visor unless it is deliberately reoriented by the wearer.

Since the sliding assembly 40 is sandwiched between headband 50 and band 24 and/or the crown 20, there is a smooth continuous gliding motion, and the mechanism never touches the head of the wearer.

The present invention having been thus described with particular reference to the preferred forms thereof, it will be obvious that various changes and modifications may be made therein without departing from the spirit and scope of the present invention.

What is claimed is:

1. A hat comprising:

a crown portion adapted to cover a portion of a wearer's head, the crown portion comprising a lower horizontal periphery, a central vertical axis, an outside, and an inside;

a horizontally oriented brim;

a headband disposed radially inwardly from the inside of the crown portion;

a circumferential intermediate band disposed between the inside of the crown portion and the headband, the circumferential band having a bottom edge attached to the lower periphery and a top edge attached to the headband; and a sliding assembly disposed between the headband and the circumferential band, the sliding assembly comprising a first member secured along the circumferential band recessed from the bottom edge, and a second member secured to the brim by an extension and slidably attached to the first member, whereby the brim is rotatable relative to the crown portion.

2. The hat of claim 1, wherein the first member is a T-shaped track and the second member is a C-shaped channel.

3. The hat of claim 2, wherein the C-shaped channel is vertically oriented with its opening facing up toward the T-shaped track, and wherein the T-shaped track is vertically oriented with its crossbar facing down toward the C-shaped channel.

4. The hat of claim 1, wherein the extension has a vertical orientation.

5. The hat of claim 1, wherein the first and second members are made of nylon.

6. The hat of claim 1, wherein the first member has a height measured along a line that is substantially perpendicular to the lower periphery, and wherein the first member is recessed from the lower periphery a distance equal to or greater than its height.

7. The hat of claim 6, wherein the first member is about 0.5 cm in height, and wherein the first member is recessed from the lower periphery a distance of about 0.5 cm.

8. The hat of claim 1, wherein the first member comprises a continuous, unbroken, elongated first member that extends completely around the inner side of the crown portion.

9. The hat of claim 1, wherein the first member comprises an elongated member extending around the inner side of the crown portion, the elongated member having a pair of side edges defining a gap there between, and wherein the first member further comprises a bridging member at least partially connecting the first and second side edges.

10. The hat of claim 1, wherein the second member of the sliding assembly is adapted to be removed from the first member.

11. The hat of claim 10, wherein the first member comprises an elongated member extending partially around the inner side of the crown portion, the elongated member having a pair of side edges defining a gap there between, and wherein the second member of the sliding assembly is adapted to be removed from the first member by separating the side edges and sliding the second member through the gap.

12. The hat of claim 1, wherein the crown portion extends from the lower peripheral edge to an upper periphery edge, whereby the crown portion is a cylindrical shape comprising a lower opening and an upper opening.

13. The hat of claim 1, wherein the crown portion further comprises a front segment, and wherein on the outside of the crown portion at the front section there is attached a primary decorative symbol, letter, word, badge, emblem, or logo.

14. The hat of claim 13, wherein the crown portion further comprises a plurality of side segments, and wherein on the outside of the crown portion at one or more of the side segments there is attached at least one secondary decorative symbol, letter, word, badge, emblem, or logo.

15. A hat comprising:

a crown portion adapted to cover a portion of a wearer's head, the crown portion comprising a lower periphery, an outside, and an inside;

a horizontally oriented brim;

a headband disposed radially inwardly from the inside of the crown pardon;

a sliding assembly disposed between the inside of the crown portion and the headband, the sliding assembly comprising a first member secured along the inside of the crown portion and recessed from the lower periphery, and a second member slidably attached to the first member and comprising an extension secured to the brim; and wherein said extension has a vertical orientation, whereby the user may rotate the brim relative to the crown portion a full 360 degrees.

16. The hat of claim 15, wherein the first member is a T-shaped track and the second member is a C-shaped channel.

17. The hat of claim 16, wherein the C-shaped channel is vertically oriented with its opening facing up toward the T-shaped track, and wherein the T-shaped track is vertically oriented with its crossbar facing down toward the C-shaped channel.

18. The hat of claim 15, wherein the first and second members are made of nylon.

19. The hat of claim 15, wherein the first member comprises a continuous, unbroken, elongated first member that extends completely around the inner side of the crown portion.

20. The hat of claim 15, wherein the second member of the sliding assembly is adapted to be removed from the first member.

21. The hat of claim 20, wherein the first member comprises an elongated member extending partially around the inner side of the crown portion, the elongated member having a pair of side edges defining a gap there between, and wherein the second member of the sliding assembly is adapted to be removed from the first member by separating the side edges and sliding the second member through the gap.

22. The hat of claim 15, wherein the crown portion extends from a lower peripheral edge to an upper periphery edge, whereby the crown portion is a cylindrical shape comprising a lower opening and an upper opening.

23. The hat of claim 15, wherein the crown portion further comprises a front segment, and wherein on the outside of the crown portion at the front section there is attached a primary decorative symbol, letter, word, badge, emblem, or logo.

24. The hat of claim 23, wherein the crown portion further comprises a plurality of side segments, and wherein on the outside of the crown portion at one or more of the side segments there as attached at least one secondary decorative symbol, letter, word, badge, emblem, or logo.

25. The hat of claim 15, wherein the first member comprises a continuous, unbroken, elongated first member that extends completely around the inner side of the crown portion.

26. A hat comprising:

a crown portion adapted to cover a portion of a wearers head, the crown portion comprising a lower periphery, an outside, and an inside;

a horizontally oriented brim;

a headband disposed radially inwardly from the inside of the crown portion;

a sliding assembly disposed between the inside of the crown portion and the headband, the sliding assembly comprising a first member secured along the inside of the crown portion and recessed from the lower periphery, and a second member slidably attached to the first member and comprising an extension secured to the brim; and wherein said first member has a height measured along a line that is substantially perpendicular to said lower periphery, and wherein said first member is recessed from said lower periphery a distance equal to or greater than its height, whereby the user rotate the brim relative to the crown portion a full 360 degrees.

27. The hat of claim 26, wherein the first member is about 0.5 cm in height, and wherein the first member is recessed from the lower periphery a distance of about 0.5 cm.

28. A hat comprising:

a crown portion adapted to cover a portion of a wearer's head, the crown portion comprising a lower periphery, an outside, and an inside;

a horizontally oriented brim;

a headband disposed radially inwardly from the inside of the crown portion;

a sliding assembly disposed between the inside of the crown portion and the headband, the sliding assembly comprising a first member secured along the inside of the crown portion and recessed from the lower periphery, and a second member slidably attached to the first member and comprising an extension secured to the brim; and wherein said first member comprises an elongated member extending around the inner side of the crown portion, said elongated member having a pair of side edges defining a gap there between, and wherein said first member further comprises a bridging member at least partially connecting said first and second side edges, whereby the user may rotate the brim relative to the crown portion a full 360 degrees.

29. A hat comprising:

a crown portion adapted to cover a portion of a wearer's head, the crown portion comprising a horizontal lower periphery, a vertical central axis, an outside, an inside, and an adjustable assembly adapted to adjust the circumferential size of the crown portion;

a horizontally oriented brim;

a headband disposed radially inwardly from the inside of the crown portion; a sliding assembly disposed between the inside of the crown portion and the headband, the sliding assembly comprising a first member secured to the inside of the crown portion and extending parallel to and recessed from the lower periphery, and a second member slidably attached to the first member and comprising an extension secured to the brim, and wherein said extension has a vertical orientation.

30. The hat of claim 29, wherein the brim rotates at least about 180 degrees relative to the crown portion.

31. The hat of claim 29, wherein the adjustable assembly comprises a hook-and-loop closure, a buckle-and-strap closure, or an interlocking closure.

32. The hat of claim 29, wherein the first member is a T-shaped track and the second member is a C-shaped channel.

33. The hat of claim 32, wherein the C-shaped channel is vertically oriented with its opening facing up toward the T-shaped track, and wherein the T-shaped track is vertically oriented with its crossbar facing down toward the C-shaped channel.

34. The hat of claim 29, wherein the first and second members are made of nylon.

35. The hat of claim 29, wherein the second member of the sliding assembly is adapted to be removed from the first member.

36. The hat of claim 35, wherein the first member comprises an elongated member extending partially around the inner side of the crown portion, the elongated member having a pair of side edges defining a gap there between, and wherein the second member of the sliding assembly is adapted to be removed from the first member by separating the side edges and sliding the second member through the gap.

37. The hat of claim 29, wherein the crown portion extends from the lower peripheral edge to an upper periphery edge, whereby the crown portion is a cylindrical shape comprising a lower opening and an upper opening.

38. The hat of claim 29, wherein the crown portion further comprises a front segment, and wherein on the outside of the crown portion at the front section there is attached a primary decorative symbol, letter, word, badge, emblem, or logo.

39. The hat of claim 38, wherein the crown portion further comprises a plurality of side segments, and wherein on the outside of the crown portion at one or more of the side segments there is attached at least one secondary decorative symbol, letter, word, badge, emblem, or logo.

40. A hat comprising:

a crown portion adapted to cover a portion of a wearer's head, the crown portion comprising a horizontal lower periphery, a vertical central axis, an outside, an inside, and an adjustable assembly adapted to adjust the circumferential size of the crown portion;

a horizontally oriented brim; and a headband disposed radially inwardly from the inside of the crown portion; a sliding assembly disposed between the inside of the crown portion and the headband, the sliding assembly comprising a first member secured to the inside of the crown portion and extending parallel to and recessed from the lower periphery, and a second member slidably attached to the first member and comprising an extension secured to the brim, wherein the first member has a height measured along a line that is substantially perpendicular to the lower periphery, and wherein the first member is recessed from the lower periphery a distance equal to or greater than its height.

41. The hat of claim 40, wherein the first member is about 0.5 cm in height, and wherein the first member is recessed from the lower periphery a distance of about 0.5 cm.

42. A hat comprising:

a crown portion adapted to cover a portion of a wearer's head, the crown portion comprising a horizontal lower periphery, a vertical central axis, an outside, an inside, and an adjustable assembly adapted to adjust the circumferential size of the crown portion;

a horizontally oriented brim; and a headband disposed radially inwardly from the inside of the crown portion; a sliding assembly disposed between the inside of the crown portion and the headband, the sliding assembly comprising a first member secured to the inside of the crown portion and extending parallel to and recessed from the lower periphery, and a second member slidably attached to the first member and comprising an extension secured to the brim, wherein the first member comprises an elongated member extending around the inner side of the crown portion, the elongated member having a pair of side edges defining a gap there between, and wherein the first member further comprises a bridging member at least partially connecting the first and second side edges.

43. A hat comprising:

a crown portion adapted to cover a portion of a wearer's head, the crown portion comprising a horizontal lower periphery, a vertical central axis, an outside, an inside, and an adjustable assembly adapted to adjust the circumferential size of the crown portion;

a horizontally oriented brim; and a headband disposed radially inwardly from the inside of the crown portion; a sliding assembly disposed between the inside of the crown portion and the headband, the sliding assembly comprising a first member secured to the inside of the crown portion and extending parallel to and recessed from the lower periphery, and a second member slidably attached to the first member and comprising an extension secured to the brim, and a circumferential intermediate band disposed between the inside of the crown portion and the headband, the circumferential band having a bottom edge attached to the lower periphery and a top edge attached to the headband, wherein the siding assembly is disposed between the headband and the circumferential band, and wherein the first member is secured along the circumferential band at a location recessed from the bottom edge and without connection to said headband.

44. A hat comprising:

a crown portion adapted to cover a portion of a wearer's head, the crown portion comprising a lower periphery, an outside, and an inside;

a horizontally oriented brim;

a headband disposed radially inwardly from the inside of the crown portion; and a sliding assembly disposed between the inside of the crown portion and the headband, the sliding assembly comprising a first member secured along the inside of the crown portion and recessed from the lower periphery, and a second member slidably attached to the first member and comprising an extension secured to the brim, whereby the user may rotate the brim relative to the crown portion a full 360 degrees, further comprising a circumferential intermediate band disposed between the inside of the crown portion and the headband, the circumferential band having a bottom edge attached to the lower periphery and a top edge attached to the headband, wherein the sliding assembly is disposed between the headband and the circumferential band, and wherein the first member is secured along the circumferential band at a location recessed from the bottom edge and without connection to said headband.

* * * * *